United States Patent [19]

Anderson et al.

[11] 4,078,881

[45] Mar. 14, 1978

[54] PHOTOFLASH LAMP

[75] Inventors: Robert M. Anderson, Pepper Pike; Lewis J. Schupp, Chesterland; William H. Herrmann, East Cleveland, all of Ohio

[73] Assignee: General Electric Company, Schenectady, N.Y.

[21] Appl. No.: 751,462

[22] Filed: Dec. 16, 1976

[51] Int. Cl.[2] ..... F21K 5/02

[52] U.S. Cl. ..... 431/93

[58] Field of Search ..... 431/93

[56] References Cited

U.S. PATENT DOCUMENTS

| | | | |
|---|---|---|---|
| 3,700,377 | 10/1972 | Brown | 431/93 |
| 3,717,432 | 2/1973 | Demchock et al. | 431/93 |
| 3,724,991 | 4/1973 | Schupp | 431/93 |
| 3,776,685 | 12/1973 | Senft et al. | 431/93 |

*Primary Examiner*—Carroll B. Dority, Jr.
*Assistant Examiner*—Robert J. Charvat
*Attorney, Agent, or Firm*—John F. McDevitt; Lawrence R. Kempton; Frank L. Neuhauser

[57] ABSTRACT

An improved wire anvil member for a percussion ignitable type flash lamp is described having projection means to deflect hot primer particles upon ignition but which has openings permitting some of the hot primer particles to pass through for improved ignition of the principal combustible material contained in the lamp envelope. The present wire anvil can also be die-cast as an integral member utilizing commercially available zinc alloy materials.

5 Claims, 3 Drawing Figures

PHOTOFLASH LAMP

CROSS-REFERENCE TO PENDING APPLICATION

A related wire anvil construction is disclosed and claimed in pending application Ser. No. 608,886 abandoned, filed Aug. 29, 1975, in the name of L. E. Boyce and assigned to the assignee of the present invention.

BACKGROUND OF THE INVENTION

Percussive ignition type photoflash lamps in general use a hermetically sealed light-transmitting envelope usually made of glass and containing a combustion supporting gas such as oxygen and a loosely distributed filling of a suitable light-producing combustible material such as a shredded foil of zirconium, aluminum, or hafnium, for example, which, on ignition, produces a high intensity flash of actinic light. The ignition means for this type photoflash lamp in general comprises a charge of percussively sensitive fulminating primer material which is located within a readily deformable metal ignition tube sealed within and projecting from one end of a length of glass tubing which forms the lamp envelope and the other end of which is constricted and tipped off. The ignition tube extends generally axially of the tubular lamp envelope and opens thereinto, and the primer material is in the form of a coating on a wire anvil member supported within the ignition tube and extending approximately axially thereof. Flashing of such constructed percussive type photoflash lamp is initiated by a forceful mechanical impact or blow applied against the side of the metal ignition tube to deform it inwardly against the coating of fulminating material on the wire anvil to cause deflagration of the fulminating primer material up through the ignition tube and into the lamp envelope where it then ignites the filamentary combustible material disposed therein. A percussive ignition type photoflash lamp of the above described type is disclosed in U.S. Pat. No. 3,717,432 which includes a wire anvil member having an integral deflector shield for deflecting toward the side of the lamp envelope the hot particles of the primer material upon ignition and wherein said anvil member can further include integral protuberances for coaxial spacing of said anvil member within the metal ignition tube. Specifically, a pair of anvil centralizing lobes are provided by flattening the wire anvil at two closely adjacent points along the length of the anvil and in two different planes at approximately right angles to one another. Additionally, said anvil member is constructed of a suitable metallic composition of high temperature resistance and low thermal conductivity such as, for example, a stainless steel to resist melting or other forms of thermal failure upon flash lamp ignition.

In the above referenced co-pending patent application, there is described an improved wire anvil construction having a plurality of rib elements and a specially shaped lower protuberance to promote central alignment of the anvil in the metal ignition tube. The deflection collar element of said improved anvil has an uninterrupted circular contour for uniform deflection of the hot primer particles entering the lamp envelope. It has been found that the hot particles tend to become extinguished upon impingement with said collar element which gives rise to insufficient burning particles being available to reliably ignite the principal combustible material contained in the lamp envelope.

SUMMARY OF THE INVENTION

In view of the foregoing problem, it is the principal object of the present invention to provide an improved anvil member construction for a percussive type photoflash lamp that facilitates more reliable ignition of the metal combustible material contained in the lamp envelope.

Another object of the invention is to provide an anvil member which is constructed of a zinc alloy die-casting having an integral collar portion to act as an improved deflection shield upon lamp ignition.

Briefly stated, the present anvil member construction has projection means located adjacent that end of the member which extends into the lamp envelope and further includes openings for the passage of some hot primer particles directly into the lamp envelope from the metal ignition tube without deflection. The openings provided in the projection means of the modified anvil can have various forms such as notches or depressions in the edge surface or holes extending through the deflector portion itself. As a result of such modification, the primer blast will still be moderated when the primer weight in a particular lamp is more than needed to reliably ignite the principal combustible material while still enabling reliable ignition with lower primer weights or primer materials having lower blast characteristics.

In one of its embodiments, the wire anvil member is fabricated from a suitable metallic composition of high temperature resistance and low thermal conductivity such as, for example, a stainless steel and having a unitary construction wherein all structure elements are fashioned by already known mechanical forming techniques. In a preferred embodiment, the entire anvil member is a zinc alloy die-casting produced by conventional injection molding to provide more precise control and reproducibility than is generally possible with conventional metal upset swaging techniques and in which being a softer metal than the steel ignition tube now in use facilitates crimping for a more secure assembly with less distortion of the ignition tube.

The required coaxial disposition of the wire anvil member within the ignition tube can be accomplished as described in the aforementioned U.S. Pat. No. 3,717,432 patent wherein anvil centering lobes are formed by flattening the wire anvil at two closely adjacent points along the length of the anvil and in two different planes at approximately right angles to one another. In a different embodiment of the present invention, said coaxial disposition is accomplished with a plurality of rib elements being equally spaced around the circumference of the anvil member utilizing three or more of said rib elements. In still a different preferred embodiment of the present invention, the anvil member is of a two-piece construction which utilizes a metal cup that fits over the anvil shank and is then secured thereto by crimping. The flange or rim element of said metal cup is provided with a series of through holes to permit undeflected passage of some hot primer particles from the metal ignition cup to the interior of the lamp envelope.

DESCRIPTION OF THE PREFERRED EMBODIMENTS

Figure 1:
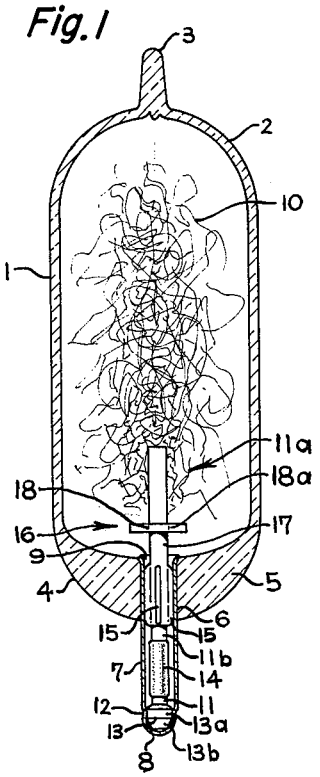
FIG. 1 is a cross-sectional view partly in elevation of a percussive type flash lamp in accordance with the present invention.

Referring to FIG. 1, there is shown a flash lamp according to the present invention which comprises a glass bulb or envelope 1 which, as shown, may be formed of a short length of glass tubing, for example, around 3/8 inch outside diameter, which is constricted and rounded off at one end as indicated at 2 and closed off thereat by an exhaust tip 3 and is formed at its other or base end 4 with a fused seal 5 about a readily deformable metal ignition tube 6 which may comprise a thin-walled (for example, 0.003 inch wall thickness) tube of a suitable metallic composition such as nickel chromium iron alloy, for instance. The envelope 1 is made of glass which is capable of forming a good hermetic seal to the particular metallic material employed for the ignition tube 6. As shown, the ignition tube 6, which may have an outside diameter of around 1/16 inch, for example, is sealed into the base end 4 of the tubular lamp envelope 1 in a position extending longitudinally and preferably axially thereof, and it projects endwise from the envelope end 4 to provide an exposed section 7. The ignition tube 6 has a closed outer end cup portion 8 and an open inner end 9 which opens into the interior space of the lamp envelope 1, and as shown, terminates approximately at the inner wall thereof. A quantity of filamentary combustible materials 10 such as a shredded foil of zirconium, aluminum or hafnium, for example, is loosely distributed within the interior space of the envelope 1 which also contains a filling of a suitable combustion-supporting gas such as oxygen.

As is also customarily employed in this type lamp construction, there is disposed within said metal ignition tube 6 and extending substantially coaxially therethrough a modified wire anvil member 11 in accordance with the present invention. More particularly, said wire anvil 11 is of a unitary formed construction having an upper body portion 11*a* extending into the lamp envelope 1 and a lower body portion 11*b* disposed within the projecting portion 7 of the ignition tube 6. Said anvil member is suitably held or fastened in place in the ignition tube 6 by a circumferential indenture 12 of the tube 6 near its outer end which grips an enlarged protuberance 13 located at the lower extremity of said anvil member and with said protuberance being formed in the shape of a concentric cylindrical body 13*a* terminating in an integral tapered section 13*b*. As shown, the wire anvil 11 is of slightly small diameter than the inside diameter of the ignition tube 6 so as to be spaced a slight distance, for example, around 0.05 inch or so from the inside wall thereof, and it is provided with a thin coating 14 of a percussively-sensitive primer or fulminating material over an appreciable lengthwise extent of that portion of the wire anvil located within the projecting portion 7 of the ignition tube 6. The coating 14 of primer material is of a thickness such as to be spaced a slight distance of around a few thousandths of an inch or so, for example, 0.004 inch from the inside wall of the ignition tube.

To aid in supporting the wire anvil 11 substantially coaxially within the ignition tube 6 and assure clearance between the coating 14 of primer material and the inside wall of the ignition tube 6, the wire anvil 11 is formed near the open inert or mouth end of the ignition tube 6 with three or more protuberances or rib elements 15 equispaced more or less uniformly around the circumferential periphery of the wire anvil and having, along with protuberance 13 at the lower opposite extremity of said wire anvil, a close sliding fit within the ignition tube. The anvil centralizing ribs or lobes 15 are of a minimal thickness circumferentially of the wire anvil 11 so as to leave substantially unobstructed the annular space between the ignition tube 6 and the wire anvil 11 for the passage therethrough and into the lamp envelope 1 of the ignited particles of the primer material 14 upon ignition and deflagration thereof. As previously mentioned, said coaxial disposition of the wire anvil within said ignition tube can also be accomplished by flattening said wire anvil at two closely adjacent points along the length of said wire anvil at the same location and in two different planes at approximately right angles to one another.

As is further customary in percussively-ignitable flash lamps of the above described construction, the lamp is provided with a deflector shield 16 which is in the form of an integral collar portion 16*a* that is located at the upper body portion 11*a* of said anvil member extending into the lamp envelope 1. Said integral collar portion 16*a* can be formed by an upset or extruded construction as well as being incorporated in a die-cast construction utilizing a conventional die-casting alloy. As shown, said collar portion 16*a* is of a greater than the inside diameter of the ignition tube 6 but is spaced around its periphery from the wall of the envelope 1 a sufficient distance, for example, around 3/64 inch or so at its nearest region, to afford sufficient clearance or annual space therebetween for the passage of the ignited particles of the primer material 14 into the envelope 1 to effect the ignition of the combustible material 10 therein. In further accordance with the present invention, collar portion 16*a* of the anvil member which forms the projection means to deflect hot primer particles also includes a pair of opposed openings 18 and 18*a* located at the edge surface. Said openings in the otherwise circular shaped element modulate the primer blast so that some particles are not deflected during passage to the upper interior of the lamp envelope.

Figure 2:
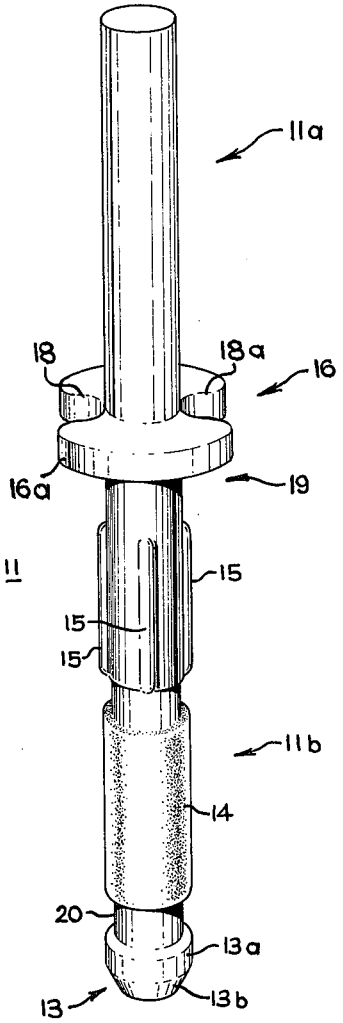
FIG. 2 is a perspective view of the primered anvil member shown in FIG. 1.

The present primered anvil member construction is shown more clearly in FIG. 2. In said embodiment, mid-portion 19 of said anvil member 11 includes a smaller diameter cross-section 20 disposed intermediate between rib elements 15 and lower protuberance 13 as a deposition zone for the primer coating 14. This diameter reduction of the anvil member further reduces the possibility of scraping primer material from the primered anvil member during assembly with the metal ignition cup and can be readily provided especially if a die-casting type construction of the anvil member is employed. As further shown in FIG. 2, the larger diameters of adjacent anvil member portions 13 and 19 also aid in precise and exacting control of primer weight as well as location. The openings 18 and 18*a* provided in the deflector projection 16*a* of the anvil can also be replaced with a series of more notches equispaced about the periphery of said collar element for additional modulation of the primer blast. In this manner, a more uniform distribution of the undeflected primer particles is provided to the interior lamp envelope.

Figure 3:
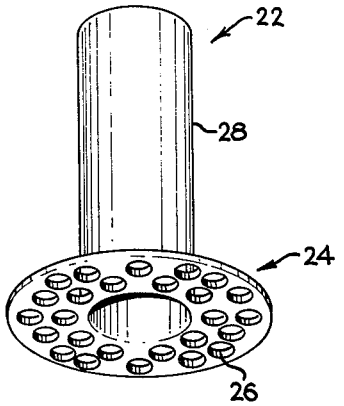
FIG. 3 is a perspective view of a different anvil member construction according to the present invention.

In FIG. 3, there is shown a separate metal cup 22 for assembly to the upper body portion 11*a* of an anvil member 11 which does not have an integral deflector shield. Said metal cup provides the modified projection means of the present invention wherein some of the hot primer particles are permitted to enter the lamp envelope without deflection. More particularly, said metal cup has a rim element 24 at the base providing a partial deflection shield which further includes a series of perforations 26 allowing direct passage of some hot particles from the metal ignition tube 6 to the interior space of the lamp envelope. The hollow upper body portion 28 of the metal cup 22 is fitted over the upper body portion 11*a* of the unshielded anvil member 11 and secured thereto in conventional fashion to provide a two-part anvil construction in accordance with the present invention.

What we claim as new and desire to secure by Letters Patent of the United States is:

1. An improved flash lamp comprising a hermetically sealed light-transmitting envelope, a quantity of filamentary combustible material loosely distributed within said envelope, a filling of combustion supporting gas in said envelope, and ignition means for said lamp comprising a readily deformable metal ignition tube sealed in and projecting from one end of said envelope and closed off at its outer end, a wire anvil disposed within and substantially coaxial with said ignition tube, said wire anvil being coated with primer material located at that portion disposed within said ignition tube and having a portion extending into said envelope which includes lateral projection means about said anvil to deflect hot particles of said primer material upon ignition, wherein the improvement comprises openings in said projection means in alignment with inside of said ignition tube for passage of some hot primer particles therethrough.

2. An improved flash lamp as in claim 1 wherein the wire anvil is constructed of a high temperature resistant and low thermal conducting material.

3. An improved flash lamp as in claim 1 wherein the wire anvil is constructed with integral projection means.

4. An improved flash lamp as in claim 1 wherein said projection means is notched at the edge surface.

5. An improved flash lamp as in claim 1 wherein said wire anvil is constructed with a separate flange element secured to the wire anvil and forming said projection means.

* * * * *